US007252197B1

(12) United States Patent
Voswinkel

(10) Patent No.: US 7,252,197 B1
(45) Date of Patent: Aug. 7, 2007

(54) ONE-PIECE GIFT BOX

(76) Inventor: Denise Voswinkel, 3 Dylan Dr., Newtown, CT (US) 06470

( * ) Notice: Subject to any disclaimer, the term of this patent is extended or adjusted under 35 U.S.C. 154(b) by 12 days.

(21) Appl. No.: 11/294,229

(22) Filed: Dec. 5, 2005

Related U.S. Application Data

(63) Continuation-in-part of application No. 10/443,497, filed on May 22, 2003, now Pat. No. 6,971,524.

(60) Provisional application No. 60/393,291, filed on Jul. 2, 2002.

(51) Int. Cl.
*B65D 5/50* (2006.01)

(52) U.S. Cl. ..... 206/762; 53/458; 206/764; 206/767; 206/232; 229/87.19

(58) Field of Classification Search ..... 206/738, 206/739, 756, 762, 764, 765, 767, 232, 45.29, 206/461, 470, 486, 784; 53/452, 456, 457, 53/458; 229/87.19, 103, 120.08, 120.09, 229/120.12, 120.15, 120.21, 120.23, 116.1
See application file for complete search history.

(56) References Cited

U.S. PATENT DOCUMENTS

| | | | | |
|---|---|---|---|---|
| 888,774 A | | 5/1908 | Wood | |
| 1,084,851 A | | 1/1914 | Ford | |
| 1,352,759 A | | 9/1920 | Markert | |
| 1,700,432 A | | 1/1929 | Cahill | |
| 2,008,949 A | | 7/1935 | Ellsworth | |
| 2,017,176 A | | 10/1935 | Andrews | |
| 2,308,177 A | | 1/1943 | Jones | |
| 2,611,529 A | | 9/1952 | Currivan | |
| 2,643,811 A | | 6/1953 | Bonding | |
| 3,539,089 A | | 11/1970 | Osberg | |
| 3,853,259 A | | 12/1974 | Tupper | |
| 4,160,502 A | | 7/1979 | Roccaforte | |
| 4,394,905 A | | 7/1983 | Hackenberg | |
| 4,925,088 A | | 5/1990 | Ostrander | |
| 5,076,492 A | | 12/1991 | Tupes | |
| 5,251,759 A | * | 10/1993 | Gannon et al. | 206/575 |
| 5,540,330 A | | 7/1996 | Lo Duca | |
| 5,586,659 A | * | 12/1996 | Trumbo | 206/768 |
| 5,938,109 A | | 8/1999 | Sainz et al. | |
| 6,158,579 A | * | 12/2000 | Rosenbaum | 206/45.29 |
| 6,375,010 B1 | * | 4/2002 | Thibault | 206/762 |
| 6,702,108 B2 | * | 3/2004 | Lo Duca | 206/232 |
| 6,913,140 B2 | * | 7/2005 | Lo Duca | 206/232 |

* cited by examiner

*Primary Examiner*—Luan K. Bui
(74) *Attorney, Agent, or Firm*—Carmody & Torrance LLP

(57) ABSTRACT

A gift box that includes a detachable gift support for insertion into a gift box after construction from a one-piece sheet of material. Gift restraints are provided for restraining the gift on the gift support. Preferably, the gift is in the shape of a card, such as the shape of a credit card, and is preferably what is known as a giftcard, similar to a gift certificate.

17 Claims, 10 Drawing Sheets

ONE-PIECE GIFT BOX

RELATED TO U.S. APPLICATION DATA

This application is a continuation in part application of U.S. application Ser. No. 10/443,497, filed May 22, 2003 now U.S. Pat. No. 6,971,524, which itself claims the benefit of U.S. Provisional Application No. 60/393,291 filed on Jul. 2, 2002.

BACKGROUND OF THE INVENTION

The present invention relates generally to gift boxes, and in particular, to an improved gift box construction and display arrangement that, among other things, provides for a more particularized and aesthetically pleasing as well as improved display and construction of a gift box for a gift, such as a gift card.

One-piece gift boxes are well-known, examples of which are described in U.S. Pat. Nos. 1,084,851; 2,643,811 and 4,925,088. Other box constructions are known, some of which were cited during prosecution of parent application Ser. No. 10/443,497, the subject matter of this application Ser. No. 10/443,497 being incorporated by reference as if fully set forth herein. While the prior art gift boxes may be satisfactory for their intended uses, they all are perceived to be deficient in various respects.

The present inventor has discovered that still further improvements in the art are desirable and has also recognized that such improvements to the state of the art are achievable. In particular, a perceived deficiency in the prior art is the lack of a desirable display configuration of such a gift box in a collapsed position at a point of sale. Moreover, the prior art lacks a satisfactory construction of such a gift box having a gift support, particularly for gift cards.

As such, the present invention overcomes the perceived deficiencies in the prior art as well as providing the objectives and advantages set forth above and below.

SUMMARY OF THE INVENTION

Therefore, it is an object and advantage of the present invention to provide an improved one-piece gift box.

It is a further object and advantage of the present invention to provide an improved one-piece gift box that aesthetically displays gift cards.

It is another object and advantage of the present invention to provide an improved one-piece gift box that is inexpensive to manufacture and easy to construct.

In particular, it is an object of the present invention is to provide a gift support for displaying a gift, such as a gift card, in such a box, in which the gift support is detachably coupled to the material forming the one-piece box.

Yet another object and advantage of the present invention is to provide an improved construction for displaying the gift box, and in particular for hangingly displaying such a gift box in a collapsed position.

To this end, still another object and advantage of the present invention is to provide an improved gift box construction that provides for an informational panel, detachably coupled to the gift box, for improving the aesthetic display and conveying useful information about the use and/or function of the gift box.

Further objects and advantages of this invention will become more apparent from a consideration of the drawings and ensuing description.

The invention accordingly comprises the features of construction, combination of elements, arrangement of parts and methodology of construction that will be exemplified in the disclosure hereinafter set forth, and the scope of the invention will be indicated in the claims.

To overcome the perceived deficiencies in the prior art and to achieve the objects and advantages above and below, the present invention in a preferred but not limiting embodiment, generally speaking, is directed to a gift box that is displayable in a collapsed position at a point of sale, wherein the gift box is formed of a unitary sheet of material comprising a first sidewall having a first edge and a second edge, a second sidewall having a first edge and a second edge, wherein the first edge of the second sidewall is coupled to the second edge of the first sidewall at a first foldline; a third sidewall having a first edge and a second edge, wherein the first edge of the third sidewall is coupled to the second edge of the second sidewall at a second foldline; a fourth sidewall having a first edge and a second edge, wherein the first edge of the fourth sidewall is coupled to the second edge of the third sidewall at a third foldline, and the first sidewall is coupled to the fourth sidewall so as to define a region perimetered by the first, second, third and fourth sidewalls, a box top having a first edge coupled to a top edge of the fourth sidewall at a fourth foldline, and a box bottom having a first edge coupled to a bottom edge of the second sidewall at a fifth foldline, wherein the gift box further comprises a gift support detachably coupled to a top edge of the second sidewall when the gift box is displayed in the collapsed position; wherein in the collapsed position an exterior surface of the box top is in facing alignment with the gift support so that at the point of sale, the gift support blocks at least essentially the entire exterior surface of the box top from view.

In another preferred embodiment, a method of constructing a gift box for a gift card that is to be placed therein is provided. In the preferred method, the box is constructed from the unitary sheet of material set forth above that has been previously placed into a collapsed position for display at a point of sale, and the method of constructing the gift box comprises the steps of opening the collapsed gift box so as to view the exterior of the box top; separating the sidewalls so as to expand the region perimetered by the first, second third and forth sidewalls; positioning the box bottom in the region so as to maintain the integrity of the expanded region; inserting the gift support into the expanded region; and folding the box top to encapsulate a gift card positioned on the gift support.

BRIEF DESCRIPTION OF THE DRAWINGS

The above set forth and other features of the invention are made more apparent in the ensuing Description of the Preferred Embodiments when read in conjunction with the attached Drawings, wherein.

Like reference numbers among the figures are intended to denote like elements, although not every feature/element is numbered in each figure.

DETAILED DESCRIPTION OF THE PREFERRED EMBODIMENTS

Reference shall be made generally to FIGS. 1–10 for a general description of the construction of and method for forming a gift box in accordance with the present invention, and where appropriate, reference will be made to specific figures for ease of understanding.

Generally speaking, the figures illustrate the construction of a one-piece gift box, generally indicated at 10. Gift box 10 is preferably for a gift that is preferably releasably secured therein.

Although not limited thereto, the gift is preferably what is known as a giftcard, similar to a gift certificate, and usually in the shape of a credit card. However, reference herein to "gift" should not be so limiting, and should be deemed to include any small item that can be placed and/or secured to the gift support in a manner disclosed below.

Also, references herein to "top," "bottom" and similar relative terms should be understood to be meant in an illustrative sense to provide a frame of orientation, and should not be used nor are they being used in a manner meant to limit or narrow the scope of the invention. Lastly, although the disclosure of the invention, and the claims themselves, may set forth steps in a particular order, unless explicitly indicated, it should be understood that the claimed invention is not limited to a particular order of carrying out the steps, since the invention is directed to the novel and non-obvious combination of steps, not their particular order, unless so explicitly indicated in the claims.

Figure 1:
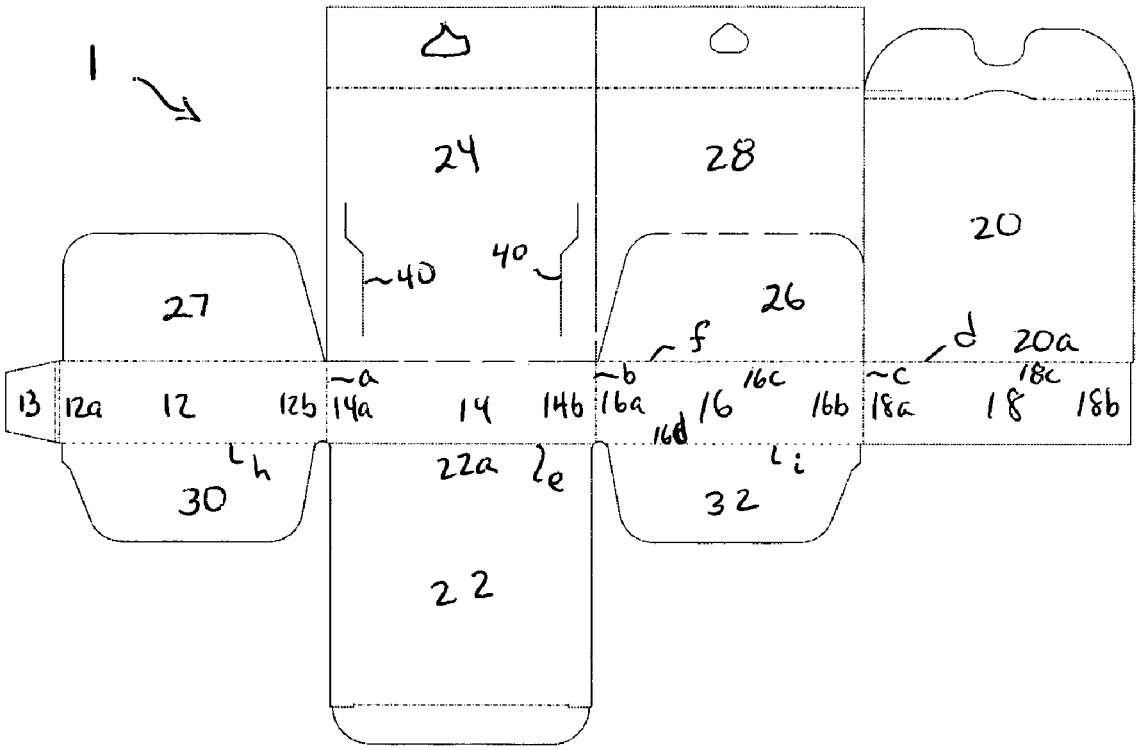
FIGS. 1–10 are views of the present invention in various stages of construction, wherein the section entitled Detailed Description of the Preferred Embodiments makes particular reference to the specific figures for ease of understanding.

With reference first being made to FIG. 1 in particular, a detailed disclosure of all the sections of the material that comprises box 10 shall first be provided.

Specifically, the unitary sheet of material, generally indicated at 1, which will hereinafter be seen to form the collapsed gift box 10 at the point of sale, preferably comprises a first sidewall 12 having a first edge 12*a* and a second edge 12*b*, a second sidewall 14 having a first edge 14*a* and a second edge 14*b*, wherein the first edge of the second sidewall is coupled to the second edge of the first sidewall at a first foldline (a); a third sidewall 16 having a first edge 16*a* and a second edge 16*b*, wherein the first edge of the third sidewall is coupled to the second edge of the second sidewall at a second foldline (b); a fourth sidewall 18 having a first edge 18*a* and a second edge 18*b*, wherein the first edge of the fourth sidewall is coupled to the second edge of the third sidewall at a third foldline (c), and the first sidewall is coupled to the fourth sidewall so as to define a region perimetered by the first, second, third and fourth sidewalls, a box top 20 having a first edge 20*a* coupled to a top edge 18*c* of the fourth sidewall at a fourth foldline (d), and a box bottom 22 having a first edge 22*a* coupled to a bottom edge 14*c* of the second sidewall at a fifth foldline (e).

Figure 2:
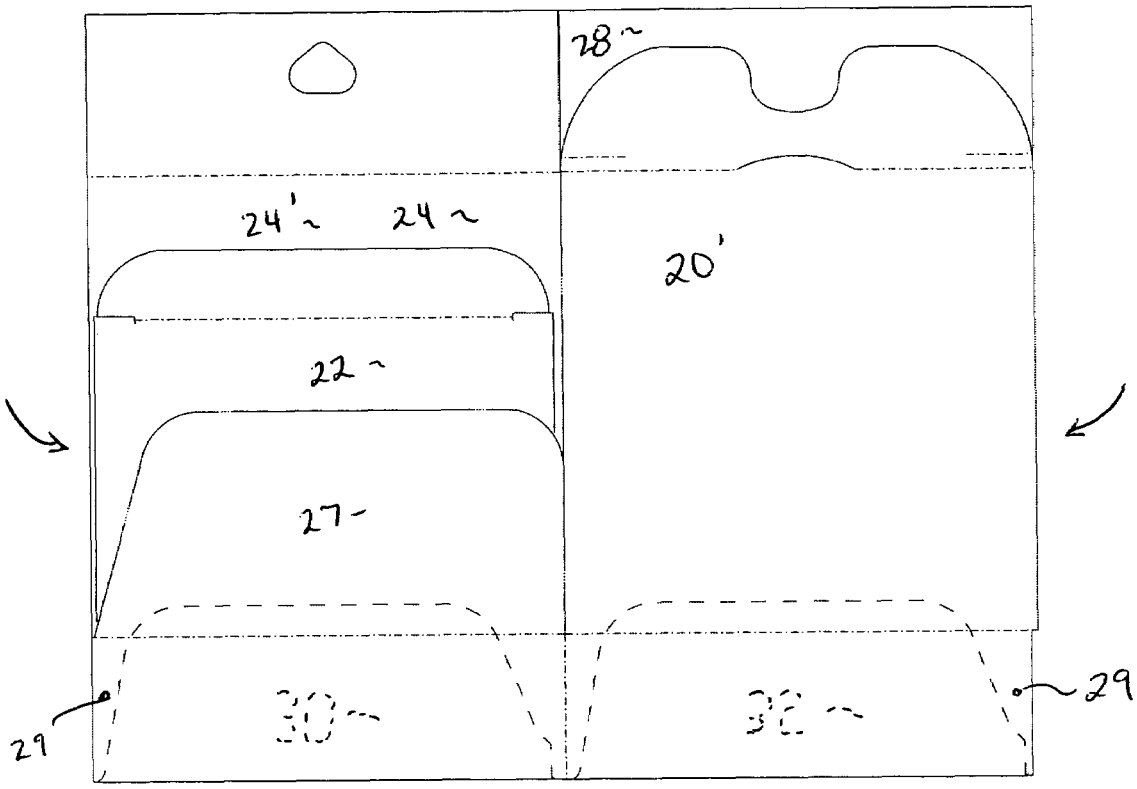
Figure 3:
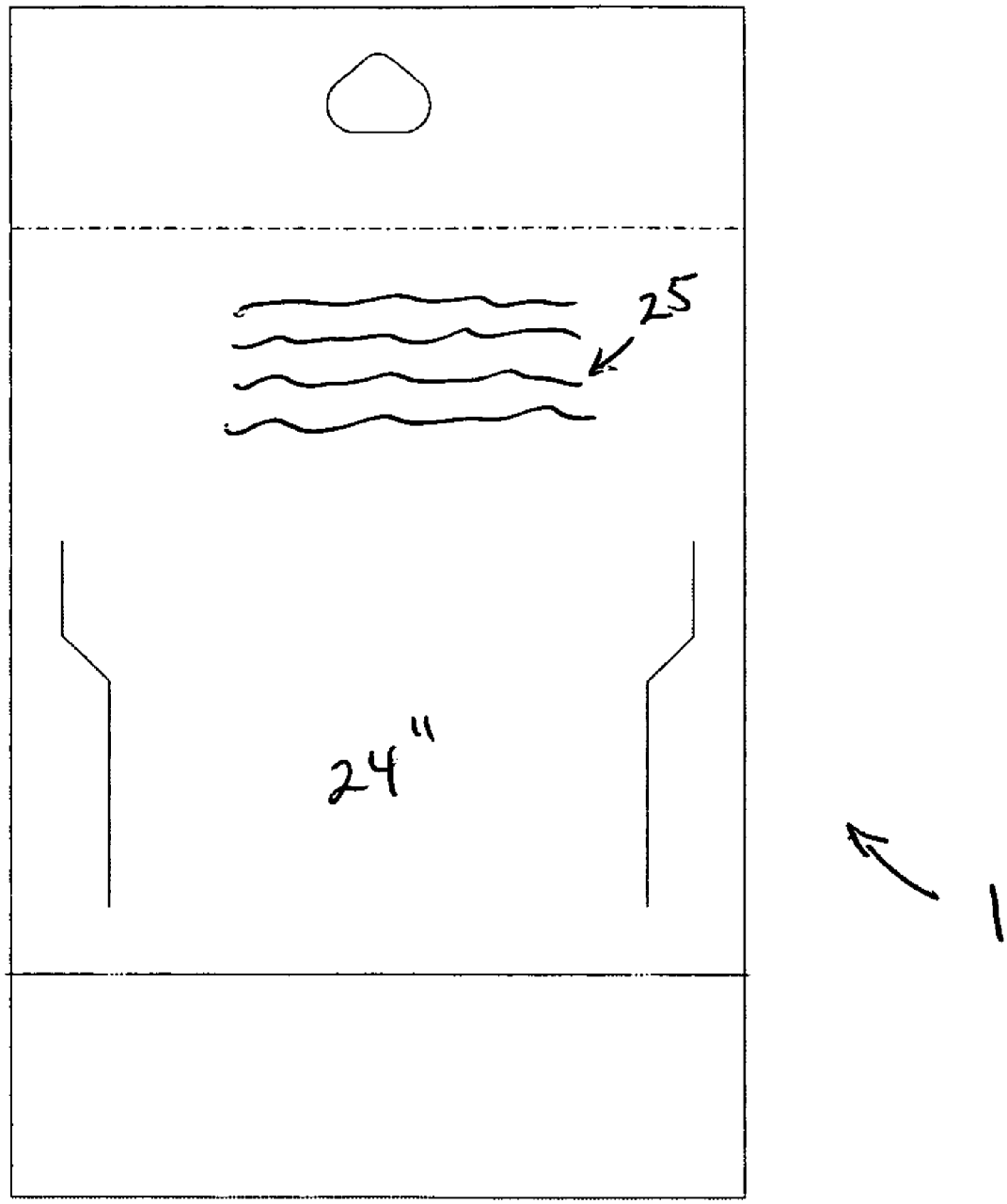
Figure 4:
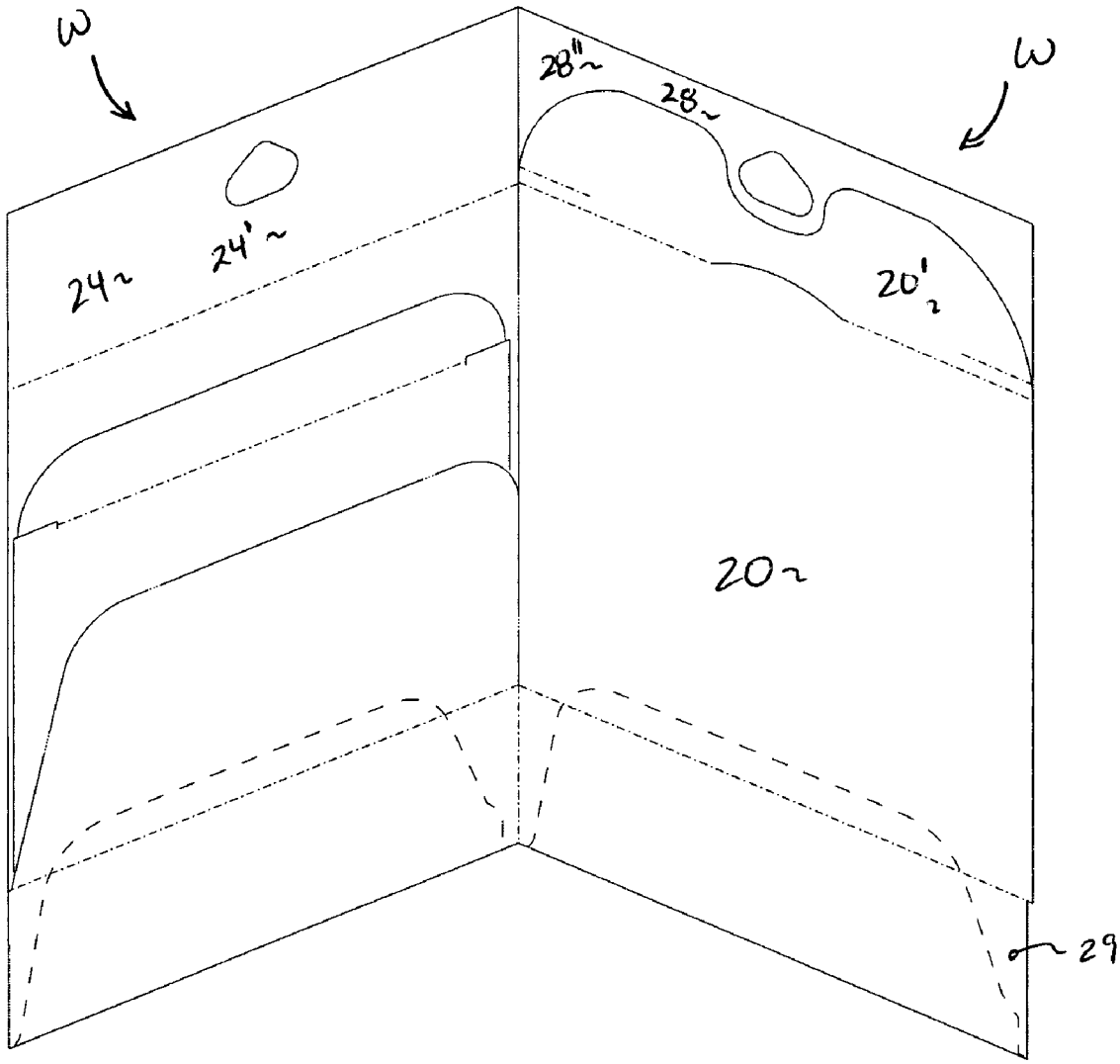
Figure 5:
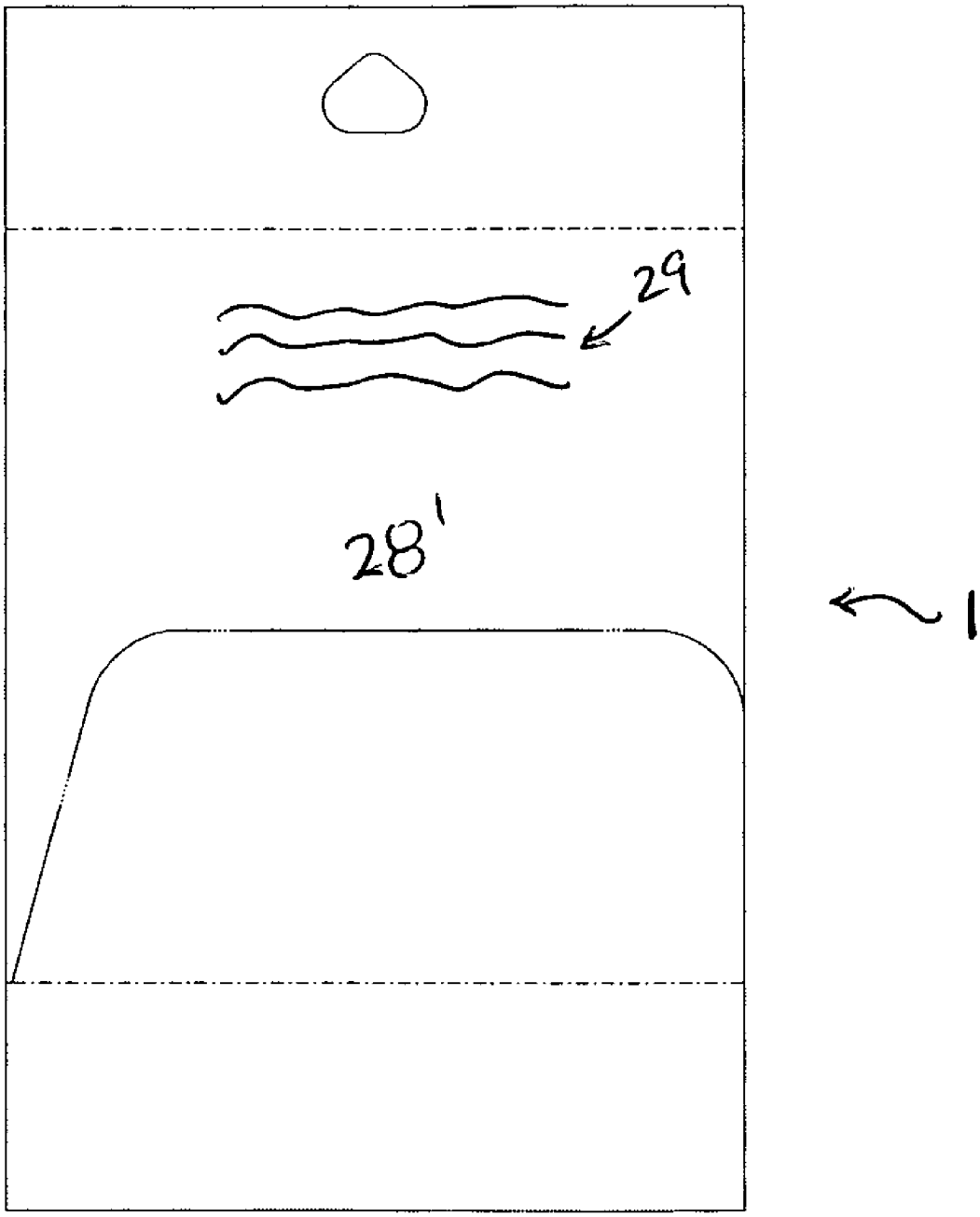

In the collapsed position, a gift support 24 is detachably coupled to a top edge 14*d* of the second sidewall. In this way, in the collapsed position, an exterior surface 20' of the box top 20 (FIG. 4) is in facing alignment with gift support 24 so that at the point of sale, gift support 24 blocks at least essentially the entire exterior surface of the box top from view, as shown in FIG. 3. In particular, in the collapsed position, the exterior surface 20' of the box top 20 will be in facing alignment with an interior surface of 24' the gift support 24, as illustrated in FIGS. 2 and 4. One or more adhesive dots 29 (or the like) are preferably used to couple the outer surface of first sidewall 12 to the outer surface of fourth sidewall 18 (and/or can be used to couple any other surfaces) to maintain closure of the gift box in the collapsed position.

As can be easily seen in FIG. 3, in the collapsed position, an exterior surface 24" of the gift support 24 is in view and contains written indicia 25 indicating use and/or instructions relating to the function of the gift box. In a specific embodiment, the gift support 24 has means for being suspended from/on a display hook, which can be in the form of an aperture, slot, tab, hook or any other element on which to suspend the gift box from and/or on the display hook.

Turning again to FIG. 1, the gift box of the present invention preferably, but not necessarily, includes a flap 26 coupled to a top edge 16*c* of the third sidewall at a sixth foldline (f). The gift box in the collapsed position may also comprise an informational panel 28, detachably coupleable to the flap 26. In this configuration, when displayed in the collapsed position, box top 20 is positioned intermediate the gift support 24 and the informational panel 28, which can be seen in FIG. 4, for example, when folded in the directions of arrows "w".

Figure 6:
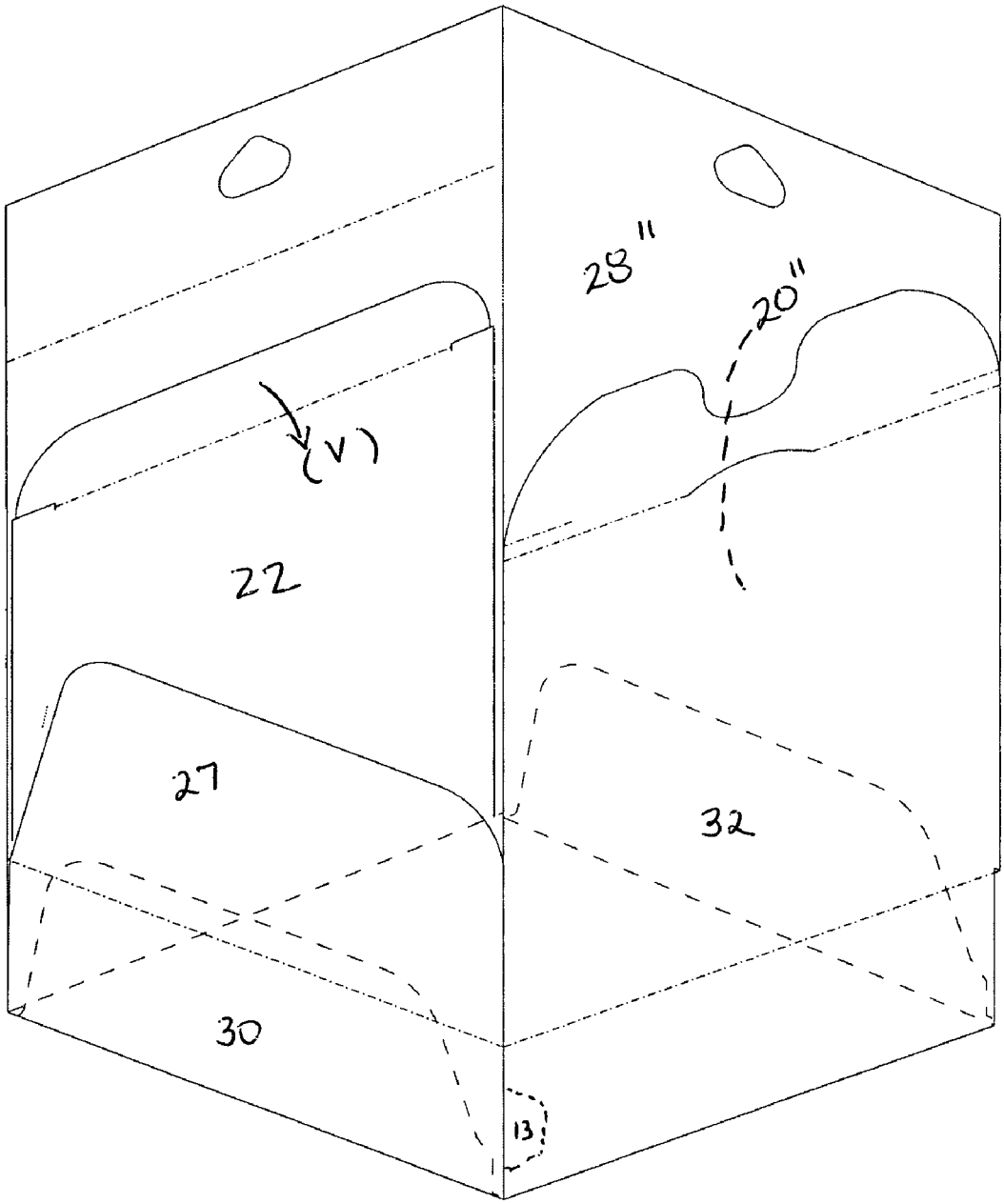

In the preferred embodiment, the informational panel 28 is detachable from the gift box and forms no part of the structure used to form the gift box. In a specific embodiment, the informational panel 28 comprises means for being suspended from/on a display hook, which likewise can take the form of an aperture, slot, tab, hook or any other element on which to suspend the gift box from and/or on the display hook. As illustrated in FIGS. 4 and 6, when in the collapsed position, an interior surface 20" of the box top 20 is in direct facing alignment with an interior surface 28" of the informational panel 28. When the gift box of FIG. 4 is folded and adhesively maintained in the fully collapsed position (i.e. in FIG. 5), an exterior surface 28' of the informational panel 28 is preferably in view and contains written indicia 29 indicating use and/or instructions relating to the function of the gift box.

Returning again to FIG. 1, in a specific embodiment, gift support 24 includes a gift support supporter 30 coupled to the gift support at foldline (g) for maintaining the gift support 24 at a non-parallel angle with respect to the box bottom 22 when the gift box is constructed (FIG. 9) and the gift support 24 is detached from the second sidewall 14 and positioned in the expanded region perimetered by the first, second, third and fourth sidewalls. Alternatively, the gift support supporter could be constructed so that the gift support 24 can be positioned at essentially a parallel angle with respect to the box bottom 22 when the gift box is constructed and the gift support is detached from the second sidewall and positioned in the region. The angled configuration, however is preferable.

It can thus be seen that a novel and non-obvious point of sale collapsible display box is provided by the present invention. In particular, the foregoing display provides for the novel display of a gift box with a detachable gift support wherein the gift support itself, or the informational panel, can be used/provide for indicating use and/or instructions relating to the function and/or construction of the gift box. Either way, however, a compact, inexpensive to manufacture (but easy to construct) one-piece gift box is provided.

Figure 7:
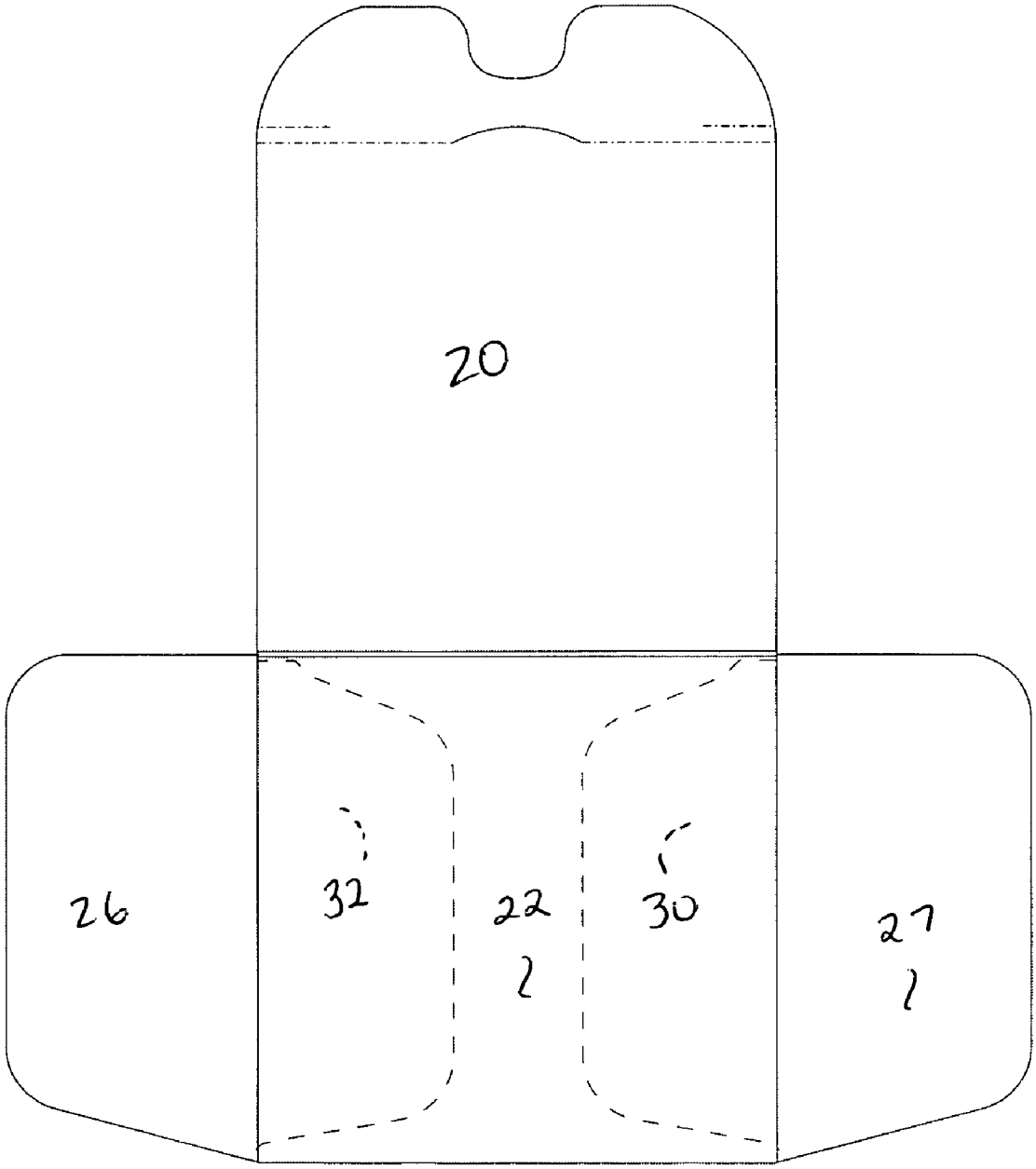

As such a unique method of constructing such a gift box for a gift card that is to be placed therein is provided. In particular, beginning with the box in the collapsed position in one or both of the collapsed positions as illustrated in FIGS. 3 and/or 5, the method of constructing the gift box comprises the steps of opening the collapsed gift box so as to view the exterior of the box top. This is achieved from taking the collapsed box as illustrated in FIGS. 3 and/or 5 and opening it to the position in FIGS. 2 and 4. Thereafter, the method comprises the steps of separating the sidewalls, so as to expand the region perimetered by the first, second third and fourth sidewalls, positioning the box bottom 22 in the expanded region so as to maintain the integrity of the expanded region (as illustrated in FIG. 7 and by arrow "v" in FIG. 6), inserting the gift support 24 into the expanded region as illustrated in the exploded view of FIG. 8 and the completed insertion of FIG. 9, and folding the box top 20 at the fourth foldline (d) to encapsulate a gift card positioned on the gift support (FIGS. 9 and 10).

To further assist in maintaining the integrity of the completed gift box 10, the unitary sheet of material preferably also comprises a first bottom supporting flap 30 coupled to a bottom edge 12*c* of first sidewall 12 at a foldline (h) and a second bottom supporting flap 32 coupled to a bottom edge 16*d* of third sidewall 16 at a foldline (i), wherein in the collapsed position (and as illustrated in many of the figures), the first bottom supporting flap 30 is in a pressed position against first sidewall 12 and second bottom supporting flap 32 is in a pressed position against third sidewall 16. In this way, the method of constructing the gift box also preferably comprises the steps of extending the first and second bottom supporting flaps prior to the step of positioning the box bottom in the expanded region in order to provide support to the box bottom when placed in the region.

Figure 8:
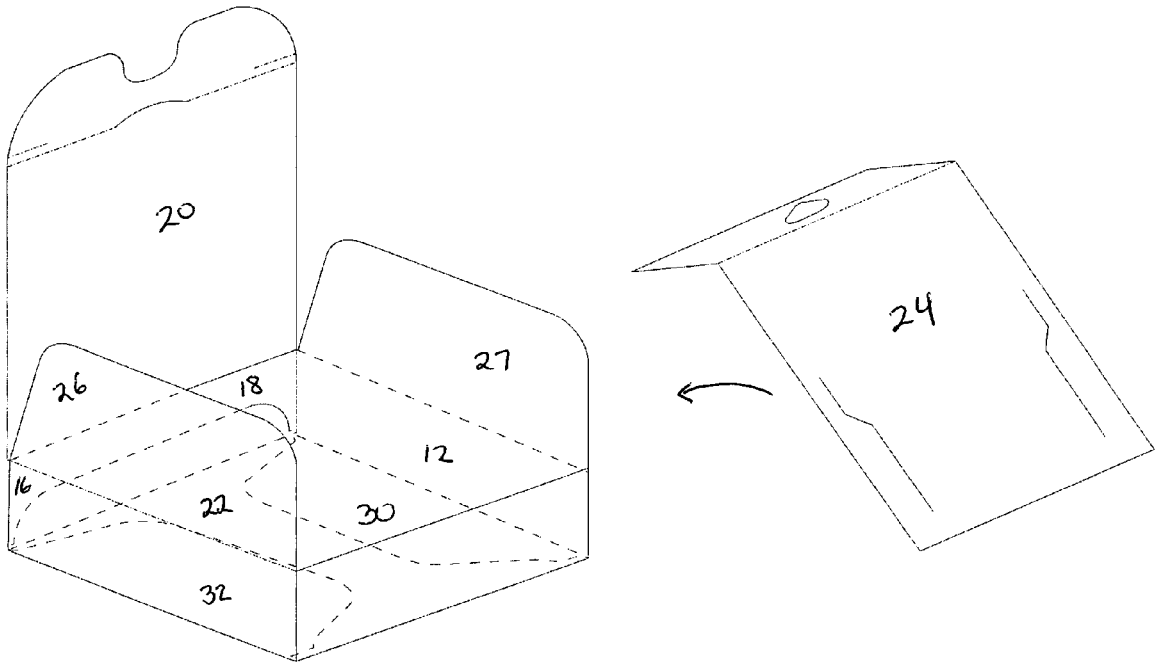
Figure 9:
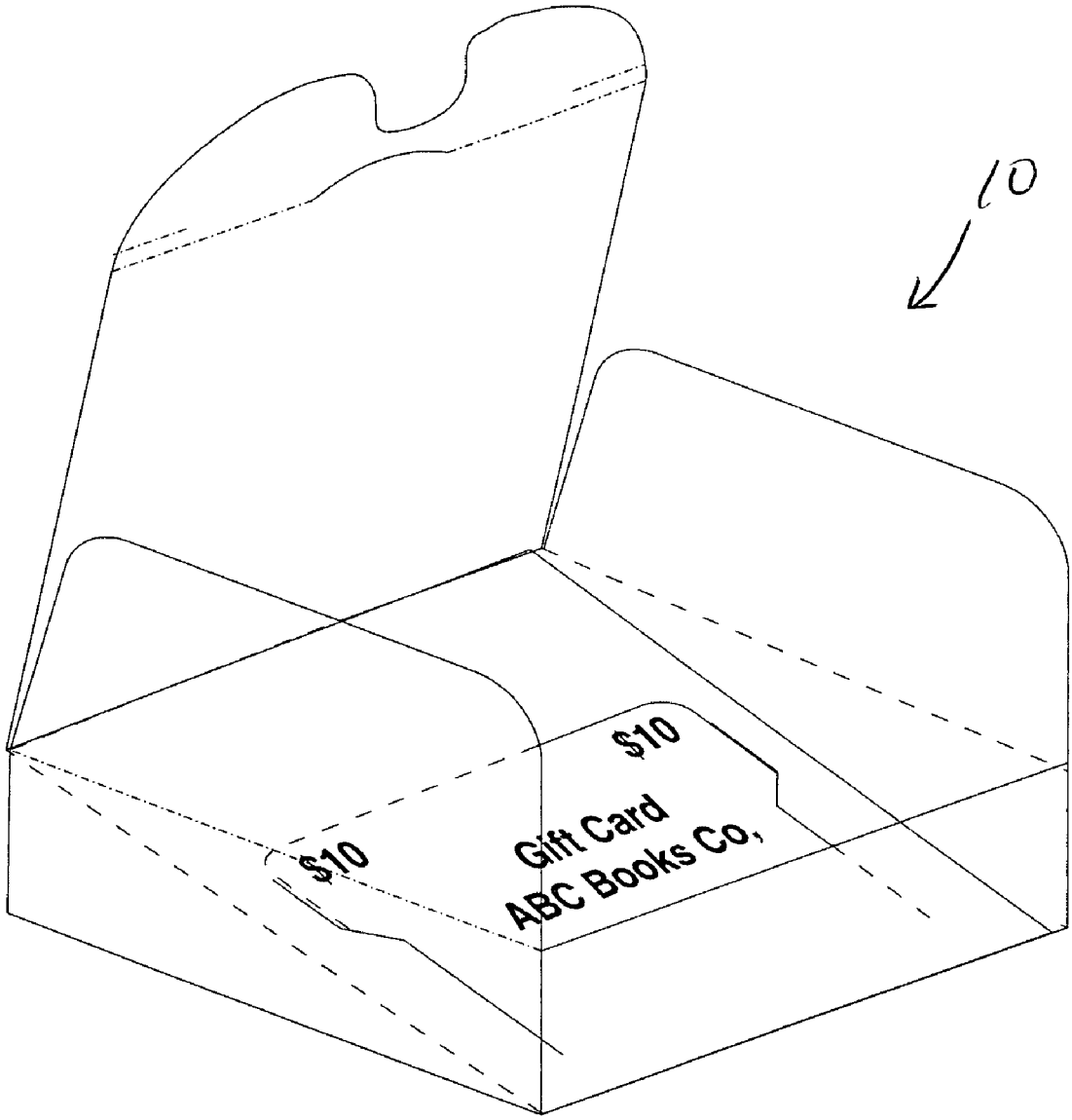
Figure 10:
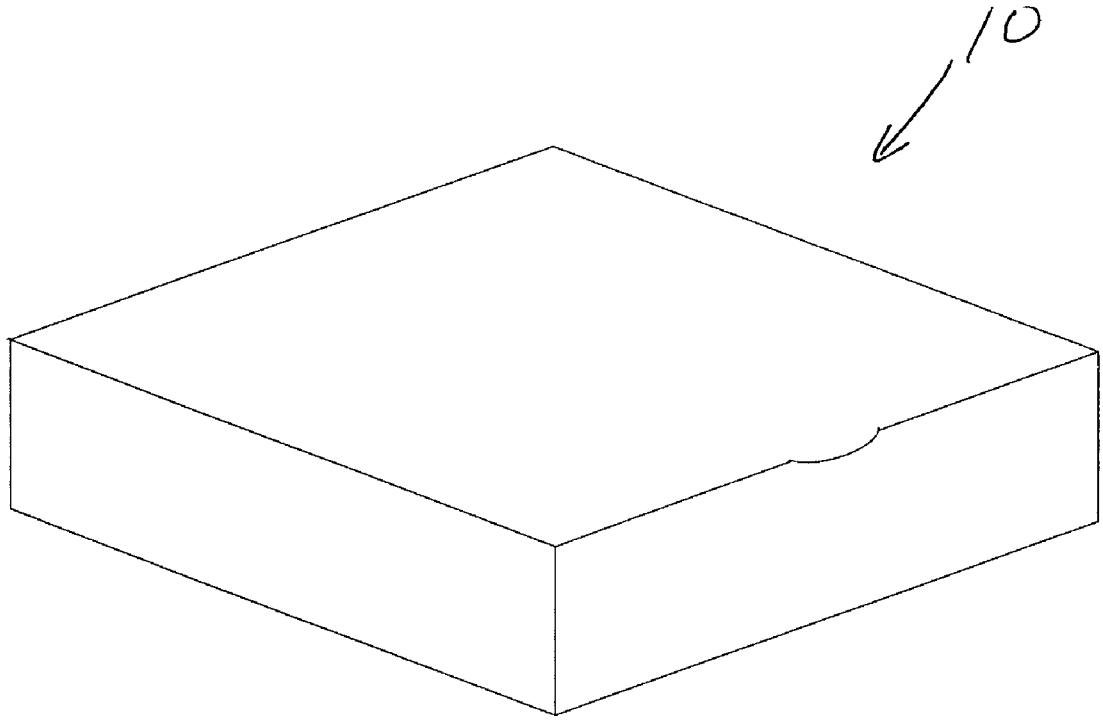

Flap 26 and a flap 27 (coupled to a top edge 12*d* of first sidewall 12), preferably also provide further integrity to gift box 10 when constructed, as illustrated in FIGS. 8 and 9.

Again, as indicated above, unless otherwise indicated, the specific order of the steps set forth herein are not material to the invention. Notwithstanding that, in a preferred embodiment, the step of detaching the gift support from the second sidewall is performed prior to opening the collapsed gift box of FIGS. 2 and 4.

Again, if an informational panel of the type disclosed herein is provided, the preferred method will comprises the further step of detaching the informational panel from the gift box prior to opening the collapsed gift box. This is because the informational panel, although functional for providing information as set forth above, forms no part of the final constructed gift box.

Lastly, although both a parallel and non-parallel gift support orientation is contemplated, the preferred method comprises the step of folding the gift support supporter relative to the gift support at the foldline coupling the two and inserting the gift support into the region and angling it at the non-parallel angle; whereby a gift card positioned thereon is viewable in the constructed gift box, as illustrated in FIG. 9.

As illustrated in FIGS. 1 and 6, gift box 10 is formed by coupling the first sidewall 12 to the fourth sidewall 18 so as to define the aforementioned region. This coupling is preferably achieved by the use of tab 13, which is adhered, such as by glue or other adhesive or coupling means, to the inner (or outer if desirable) surface edge of fourth sidewall 18. This is clearly illustrated in FIG. 6 by way of example.

In a preferred embodiment, the gift restraints are opposing slits 40 in the gift support, although the gift restraints may be opposing bands secured to the gift support, such as by knotting ends thereof through holes formed in the gift support. FIG. 9 illustrates an exemplary gift card being a $10 card redeemable at ABC Books Co. Obviously, this is by way of example and not limitation, as many (or any) other types of gift cards and gift certificates, by way of example, can be provided. Small toys or other displayable gifts are also contemplated and covered by the present claims.

To present the giftbox, it is preferable that the gift is provided in the gift box 10 and positioning on the gift support and retrained by the gift restraints, such as the slits and given in the form as illustrated in FIG. 10.

As can now be seen, either and/or both the gift support 24 itself or the instructional panel 28 can be used to provide a means for hanging and/or otherwise displaying the gift box in the collapsed position, such as in a retail environment. In the contemplated construction, either support 24 or panel 28 includes a region on which instructions or other informational indicia (such as price tags, etc) can be printed or otherwise provided. Also, arranging the elements to be displayable in the collapsed position as disclosed herein provides a more aesthetically preferred display since many of the foldlines and portions of the material 1 that comprise and form gift box 10 can be blocked at the point of sale. Accordingly, a much more aesthetically pleasing display of the gift box can be provided, whether the collapsed gift box is hung up on a hook or laid flat in a pile.

Lastly, to be clear, both gift support 24 and panel 28 (if provided) are preferably attached (respectively to second sidewall 14 and flap 26) along a perforated edge, as denoted by the dotted lines of FIG. 1. In this way, gift support 24 can be inserted as illustrated in FIG. 8 and panel 28, after purchase and construction of gift box 10, can be easily discarded.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

In summary, it can be seen that both methods of forming one-piece gift box 1 and a gift box constructed thereby are provided. To be clear, it should be understood that the present invention, including the claims, covers alternative embodiments contemplated herein. For example, in the preferred embodiment, it is actually first sidewall 12 that is coupled to fourth sidewall 18, while the remaining of the sidewalls are actually connected via the foldlines. However, in order to prevent an unscrupulous copier from merely shifting the panels (if possible), the term "coupled" is used herein to cover both a coupling of the elements/panels/sidewalls and a direct connection, being integrally formed and separated only by a foldline. That is, it is believed that one skilled in the art would readily appreciate that the one-piece gift box and the methods of forming it are both operable and enabled by the present specification in which the gift support, box bottom, box top and information panel are orientated as illustrated. However, to the extent that another orientation is achievable while staying within the literal language of the claims, it is intended that such a construction is covered hereby. As such, certain changes may be made and/or achievable without departing from the scope of the present invention.

What is claimed is:

1. A gift box that is displayable in a collapsed position at a point of sale, wherein the gift box is formed of a unitary sheet of material comprising a first sidewall having a first edge and a second edge; a second sidewall having a first edge and a second edge, wherein the first edge of the second sidewall is coupled to the second edge of the first sidewall at a first foldline; a third sidewall having a first edge and a second edge, wherein the first edge of the third sidewall is coupled to the second edge of the second sidewall at a second foldline; a fourth sidewall having a first edge and a second edge, wherein the first edge of the fourth sidewall is coupled to the second edge of the third sidewall at a third foldline, and the first sidewall is coupled to the fourth sidewall so as to define a region perimetered by the first, second, third and fourth sidewalls, a box top having a first edge coupled to a top edge of the fourth sidewall at a fourth foldline, and a box bottom having a first edge coupled to a bottom edge of the second sidewall at a fifth foldline, wherein the gift box further comprises:

a gift support detachably coupled to a top edge of the second sidewall when the gift box is displayed in the collapsed position;

wherein in the collapsed position:

an exterior surface of the box top is in facing alignment with the gift support so that at the point of sale, the gift support blocks at least essentially the entire exterior surface of the box top from view.

2. The gift box as claimed in claim 1, wherein in the collapsed position, the exterior surface of the box top is in facing alignment with an interior surface of the gift support.

3. The gift box as claimed in claim 2, wherein in the collapsed position, an exterior surface of the gift support is in view and contains written indicia indicating use and/or instructions relating to the function of the gift box.

4. The gift box as claimed in claim 2, wherein the gift support has means for being suspended from/on a display hook.

5. The gift box as claimed in claim 2, wherein in the collapsed position:

the second sidewall blocks at least essentially the other sidewalls from view, when viewing the written indicia on the exterior of the gift support.

6. The gift box as claimed in claim 1, comprising:

a flap coupled to a top edge of the third sidewall at a sixth foldline; and an informational panel, detachably coupled to the flap, such that the box top is positioned intermediate the gift support and the informational panel when displayed in the collapsed position;

wherein the informational panel is detachable from the gift box and forms no part of the structure used to form the gift box.

7. The gift box as claimed in claim 6, wherein the informational panel comprises means for being suspended from/on a display hook.

8. The gift box as claimed in claim 6, wherein the collapsed position, the interior surface of the box top is in direct facing alignment with an interior surface of the informational panel.

9. The gift box as claimed in claim 8, wherein the collapsed position, an exterior surface of the informational panel is in view and contains written indicia indicating use and/or instructions relating to the function of the gift box.

10. The gift box as claimed in claim 1, comprising a gift support supporter connected to the gift support for maintaining the gift support at a non-parallel angle with respect to the box bottom when the gift box is constructed and the gift support is detached from the second sidewall and positioned in the region perimetered by the first, second, third and fourth sidewalls.

11. The gift box as claimed in claim 1, comprising a gift support supporter connected to the gift support for maintaining the gift support at essentially a parallel angle with respect to the box bottom when the gift box is constructed and the gift support is detached from the second sidewall and positioned in the region perimetered by the first, second, third and fourth sidewalls.

12. The gift box as claimed in claim 3, comprising a gift support supporter connected to the gift support for maintaining the gift support at a non-parallel angle with respect to the box bottom when the gift box is constructed and the gift support is detached from the second sidewall and positioned in the region perimetered by the first, second, third and fourth sidewalls.

13. A method of constructing a gift box for a gift card that is to be placed therein, wherein the box is constructed from a unitary sheet of material that has been previously placed into a collapsed position for display at a point of sale, wherein the box is formed from the unitary sheet of material comprising a first sidewall having a first edge and a second edge; a second sidewall having a first edge and a second edge, wherein the first edge of the second sidewall is coupled to the second edge of the first sidewall at a first foldline; a third sidewall having a first edge and a second edge, wherein the first edge of the third sidewall is coupled to the second edge of the second sidewall at a second foldline; a fourth sidewall having a first edge and a second edge, wherein the first edge of the fourth sidewall is coupled to the second edge of the third sidewall at a third foldline, and the first sidewall is coupled to the fourth sidewall so as to define a region perimetered by the first, second, third and fourth sidewalls, a box top having a first edge coupled to a top edge of the fourth sidewall at a fourth foldline, and a box bottom having a first edge coupled to a bottom edge of the second sidewall at a fifth foldline, wherein the gift box further comprises a gift support detachably coupled to a top edge of the second sidewall when the gift box is displayed in the collapsed position such that in the collapsed position, an exterior surface of the box top is in facing alignment with the gift support so that at the point of sale, the gift support blocks at least essentially the entire exterior surface of the box top from view; wherein the method of constructing the gift box comprises the steps of:

opening the collapsed gift box so as to view the exterior of the box top;

separating the sidewalls so as to expand the region perimetered by the first, second third and forth sidewalls;

positioning the box bottom in the region so as to maintain the integrity of the expanded region;

inserting the gift support into the expanded region; and folding the box top at the fourth foldline to encapsulate a gift card positioned on the gift support.

14. The method as claimed in claim 13, wherein the unitary sheet of material comprises a first bottom supporting flap coupled to a bottom edge of first sidewall at a foldline and a second bottom supporting flap coupled to a bottom edge of third sidewall at a foldline, wherein in the collapsed position the first bottom supporting flap is in a pressed position against the first sidewall and the second bottom supporting flap is in a pressed position against the third sidewall, wherein the method of constructing the gift box comprises the steps of:

extending the first and second bottom supporting flaps prior to the step of positioning the box bottom in the expanded region in order to provide support to the box bottom when placed in the region;

wherein additional integrity of the constructed gift box is maintained.

15. The method as claimed in claim 13, including the step of detaching the gift support from the second sidewall prior to opening the collapsed gift box so as to view the exterior of the box top.

16. The method as claimed in claim 13, wherein the gift box comprises a flap coupled to a top edge of the third sidewall at a foldline, and an informational panel, detachably coupled to the flap, such that the box top is positioned intermediate the gift support and the informational panel when displayed in the collapsed position, wherein an exterior surface of the informational panel contains written indicia indicating use and/or instructions relating to the function of the gift box, wherein the method comprises the steps of:

detaching the informational panel from the gift box prior to opening the collapsed gift box;

whereby the informational panel forms no part of the constructed gift box.

17. The method as claimed in claim 13, wherein the gift support comprises a gift support supporter for maintaining the gift support at a non-parallel angle with respect to the box bottom when the gift box is constructed and the gift support is positioned in the region perimetered by the first, second, third and fourth sidewalls; wherein the method comprises the steps of:

folding the gift support supporter relative to the gift support at the foldline coupling the two and inserting the gift support into the region and angling it at the non-parallel angle;

whereby a gift card positioned thereon is viewable in the constructed gift box.

* * * * *